US006944973B2

(12) United States Patent
Goodwin

(10) Patent No.: US 6,944,973 B2
(45) Date of Patent: Sep. 20, 2005

(54) PROTECTIVE CAGE FOR FOOTWEAR BLADDER

(75) Inventor: David Goodwin, Portland, OR (US)

(73) Assignee: Nike, Inc., Beaverton, OR (US)

( * ) Notice: Subject to any disclaimer, the term of this patent is extended or adjusted under 35 U.S.C. 154(b) by 16 days.

(21) Appl. No.: 10/688,847

(22) Filed: Oct. 17, 2003

(65) Prior Publication Data

US 2004/0123494 A1 Jul. 1, 2004

Related U.S. Application Data

(63) Continuation of application No. 09/953,978, filed on Sep. 17, 2001, now Pat. No. 6,665,958.

(51) Int. Cl.[7] ..... A43B 13/20; A43B 13/14

(52) U.S. Cl. ..... 36/29; 36/31; 36/35 R; 36/35 B

(58) Field of Search ..... 36/25 R, 28, 29, 36/31, 35 R, 35 B, 88, 92, 114

(56) References Cited

U.S. PATENT DOCUMENTS

| | | | | | |
|---|---|---|---|---|---|
| 4,219,945 | A | * | 9/1980 | Rudy | 36/29 |
| 4,506,460 | A | * | 3/1985 | Rudy | 36/28 |
| 4,610,099 | A | * | 9/1986 | Signori | 36/3 B |
| 4,817,304 | A | | 4/1989 | Parker et al. | |
| 4,906,502 | A | | 3/1990 | Rudy | |
| 5,083,361 | A | | 1/1992 | Rudy | |
| 5,220,737 | A | * | 6/1993 | Edington | 36/28 |
| 5,279,051 | A | * | 1/1994 | Whatley | 36/25 R |
| 5,353,459 | A | * | 10/1994 | Potter et al. | 12/146 R |
| 5,363,570 | A | * | 11/1994 | Allen et al. | 36/28 |
| 5,543,194 | A | | 8/1996 | Rudy | |
| 5,713,140 | A | * | 2/1998 | Baggenstoss | 36/28 |
| 5,713,141 | A | | 2/1998 | Mitchell et al. | |
| 5,729,917 | A | * | 3/1998 | Slepian et al. | 36/27 |
| 5,778,563 | A | | 7/1998 | Ahlbaumer | |
| 5,933,983 | A | * | 8/1999 | Jeon | 36/29 |
| 5,937,545 | A | * | 8/1999 | Dyer et al. | 36/35 R |
| 5,952,065 | A | | 9/1999 | Mitchell et al. | |
| 6,115,943 | A | * | 9/2000 | Gyr | 36/35 R |
| 6,119,371 | A | | 9/2000 | Goodwin et al. | |
| 6,665,958 | B2 | * | 12/2003 | Goodwin | 36/29 |
| 2002/0050077 | A1 | | 5/2002 | Wang et al. | |

OTHER PUBLICATIONS

Robert C. Juvinall, Professor of Engineering University of Michigan and Kurt M. Marshek, Professor of Mechanical Engineering University of Texas; Fundamentals of Machine Component Design, Second Edition 1991, pp. 454–455, Section 12.10 Beam Springs (Including Leaf Springs): John Wiley & Sons Publishing, USA.

* cited by examiner

*Primary Examiner*—M. C. Patterson
(74) *Attorney, Agent, or Firm*—Banner & Witcoff, Ltd

(57) ABSTRACT

A protective cage for footwear bladders is disclosed. The protective cage includes a cage base and a plurality of support members that extend outwardly from the cage base. The support members extend across the side wall of the bladder to protect the device from abrasion and to prevent fatigue. The use of the support members, which selectively bend and buckle under loaded conditions, control the amount of perimeter deflection of the bladder, while allowing for complete deflection at the center of the bladder.

31 Claims, 4 Drawing Sheets

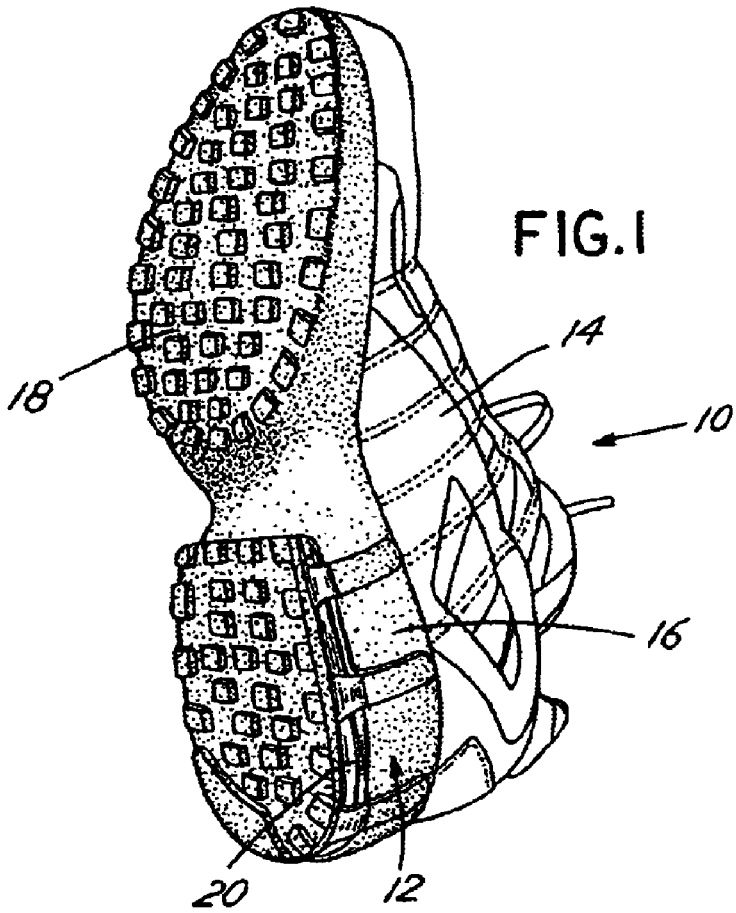
FIG.1
FIG.2
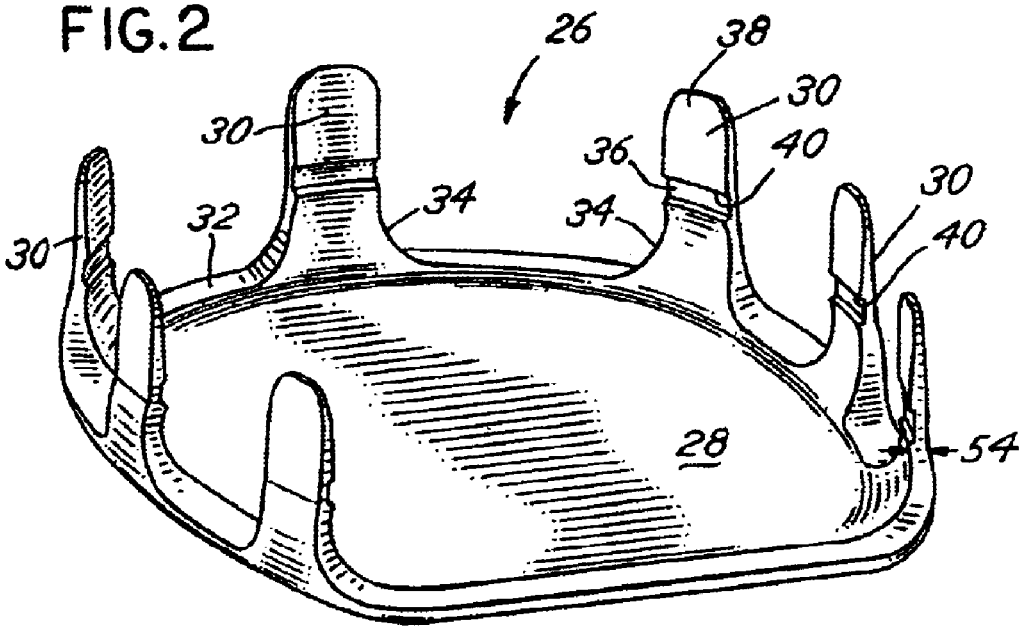

PROTECTIVE CAGE FOR FOOTWEAR BLADDER

CROSS REFERENCE TO RELATED APPLICATION

This application is a continuation of and claims the benefit of U.S. application Ser. No. 09/953,978, filed Sep. 17, 2001, now U.S. Pat. No. 6,665,958.

FIELD OF THE INVENTION

The present invention relates in general to footwear and the bladders used in footwear. More particularly, the present invention relates to a protective cage for the bladder that reduces bladder failure.

BACKGROUND OF THE INVENTION

Footwear is divided generally into two parts, an upper and a sole. The upper is the portion of the footwear designed to comfortably enclose the foot, while the sole is the portion of the footwear designed to provide traction, protection, cushioning, and a durable wear surface. Typically, the sole includes several layers, including a resilient, shock absorbent material as a midsole and a ground engaging durable material as an outsole.

Known midsoles are typically made of conventional foam materials, such as ethylene vinyl acetate (EVA) or polyurethane. These materials compress resiliently under an applied load, such as forces generated by athletes, to provide cushioning to the athlete's feet and legs. Conventional foam materials are resiliently compressible, in part, due to the inclusion of foam having open and closed cells defining an inner volume that is substantially displaced by gas. In other words, the foam includes bubbles within the material which give the foam its compressible and resilient features. Conventional foam materials, however, have certain drawbacks. Most notably, the foam materials deteriorate by compaction after repeated compression caused by extended use of the footwear. The deterioration is the result of the collapse of the cell structure within the foam, resulting in decreased compressibility of the foam and thus decreased cushioning of the midsole. A mostly successful solution to the problems associated with conventional foam materials has been the use and placement of gas-filled cushioning devices or bladders within the midsole. The bladders are inflatable inserts made of elastomeric materials that are resiliently compressible to provide cushioning to the wearer of the footwear.

There are several known bladders of varying construction, which have been used in the footwear industry. For instance, U.S. Pat. No. 6,119,371 to Goodwin, the disclosure of which is incorporated by reference, discloses a bladder formed of an outer enclosing member and an inner member. The outer enclosing member is formed of a thermoplastic polyurethane (TPU) film consisting of two layers of material. The TPU film forms the shell shape of the bladder and defines a sealed chamber. The inner member is located within the sealed chamber and is formed of spaced apart fabric layers connected together by a plurality of connecting yarns or drop threads. The sealed chamber contains a pressurized fluid to place the plurality of connecting yarns under tension. The resulting structure provides enhanced cushioning to the wearer of the footwear.

Other types of bladders are disclosed in U.S. Pat. Nos. 5,713,141 and 5,952,065 to Mitchell et al., U.S. Pat. No. 5,353,459 to Potter et al., and U.S. Pat. Nos. 4,506,460 and 4,219,945 to Rudy, the disclosures of which are incorporated by reference. These bladders are known generally as permanently filled bladders and may be manufactured by various techniques. For example, some bladders are manufactured by the prior art two-film technique in which two sheets of elastomeric film are welded together along their periphery to define an enclosed chamber. Other bladders are manufactured by the prior art blow molding technique in which a liquefied elastomeric material is placed in a mold having the desired shape of the bladder. Pressurized air is then injected into the mold to force the elastomeric material against the inner surfaces of the mold and cause the material to harden to the desired bladder shape. With either technique, the formed bladder is pressurized with a gas or liquid and sealed to create an inflated resilient bladder that provides added footwear cushioning. It will be recognized that some of these known bladders are made of multiple chambers in fluid communication with each other. Those of skill in the art will recognize that other footwear bladders exist, the details and construction of which, however, need not be discussed except to note that these bladders may be used with the present invention.

A drawback with respect to existing bladders is over flexing of the TPU film of the outer chamber. The over flexing is a result of abnormal wear of the shoe caused by abnormal loading placed on the bladder from athletes who, for example, have a tendency to pronate or supinate while running. Over time, this over flexing leads to film cracking and fatigue and ultimately bladder failure due to subsequent pressure loss in the chamber. The failures of the bladder are most prevalent in the vertical side walls of the bladder, particularly in exposed bladders—bladders not enveloped in a foam material, but visible to the outside.

In an effort to overcome the failure of existing bladders, conventional foam materials were placed around the bladder. While this effort has been somewhat successful, problems still exist with respect to the use of foam materials. As stated above, the cell structure of the foam material has a tendency to break down and deteriorate over time and use. Upon the break-down of the foam material, the bladders lose their structural support provided by the foam material and experience over flexing of the TPU film. Moreover, with the use of a foam material enclosing the bladder, the material will mask the pure cushioning response of the bladder, thus changing the perception of the footwear.

BRIEF SUMMARY OF THE INVENTION

The present invention overcomes the disadvantages of the prior art by providing a bladder support system that improves bladder durability by preventing the bladder from experiencing over flexing of the bladder film. In an exemplary embodiment, the present invention includes the use of a protective cage, which encases the bladder and provides structural support to the side walls of the bladder—the location where bladder stresses are the greatest. The support provided by this protective cage has been shown to significantly reduce if not eliminate bladder failure due to film flex fatigue. The protective cage has also been shown to protect the bladder from abrasions, which also leads to bladder film breakdown.

The protective cage of the invention generally includes a cage base or moderator surface and a plurality of spaced apart bladder support members extending outwardly from the cage base at its periphery. The bladder is positioned within the protective cage, against the cage base, and between the plurality of support members. The support members, which extend along the bladder side walls, control the amount of perimeter bladder deflection. Control of the perimeter bladder deflection, in turn, controls the stress placed on the film of the bladder under loaded conditions. Significantly, the use of the cage of the present invention results in a longer life for the bladder. In addition, the present invention still permits complete bladder deflection at the center of the bladder—the location on the bladder responsible for most of the footwear cushioning.

BRIEF DESCRIPTION OF THE DRAWINGS

The invention will be described in relation to the accompanying drawings. In the drawings, the following figures have the following general nature:

FIG. 1 is an isometric view of an article of footwear incorporating the present invention.

FIG. 2 is an isometric view of the protective cage of the present invention.

DETAILED DESCRIPTION OF THE INVENTION

Figure 3:
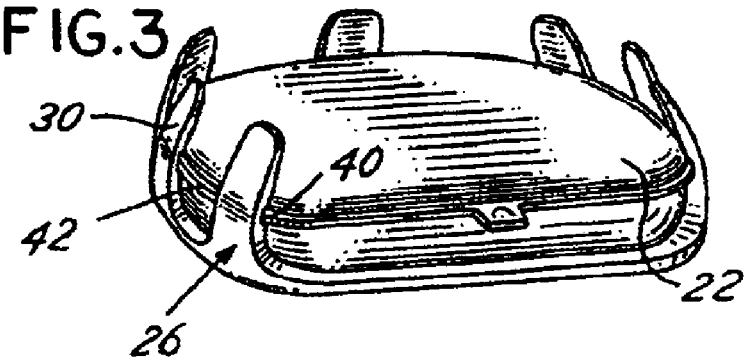
FIG. 3 is an isometric view of a bladder and protective cage of FIG. 2.

Referring to the drawings wherein like numerals indicate like elements, there is shown in FIG. 1 an article of footwear 10, such as a running shoe, incorporating an exemplary embodiment of the present invention. As depicted, the article of footwear 10 includes a sole structure 12 and an upper 14 attached to the sole structure in a conventional manner. The sole structure 12 incorporates the present invention while the upper 14 can be of any conventional design adapted to the particular use of the article of footwear. In other words, the upper will vary depending on the type of footwear (e.g., athletic shoes, sandals, in-line skates, hiking boots, etc.). As conventional, the sole structure 12 includes a cushioning or force absorbing midsole 16 and a flexible, wear resistant outsole 18. It should be understood that, where appropriate, the midsole and outsole portions may be formed as a single integral unit.

Figure 6:
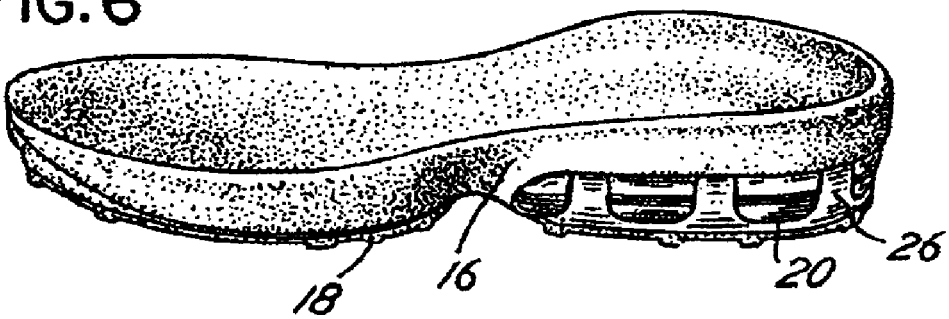
FIG. 6 is an isometric view of portions of an article of footwear incorporating the present invention.

Referring to FIGS. 1 and 6, located within the midsole is a resilient bladder or cushioning device 20, which provides cushioning to the wearer of the footwear. The bladder 20 is generally a gas-filled device made of elastomeric material and is inflated to significant pressures in order to cushion against the forces generated on the foot during strenuous athletic activities. As depicted, the bladder 20 is located in the heel area of the midsole, directly above the outsole. It will be understood by those skilled in the art that one or more bladders may be located within the sole structure 12 and at various locations along the footwear, including, but not limited to, the forefoot, midfoot and rearfoot regions of the footwear. It will also be understood that one or more of the bladders may be secured in position within the midsole in any conventional manner, such as by adhesive attachment within a recess, by encapsulation within a foam material, or by securely trapping the bladder against the midsole by snap-fitting the present invention to the midsole.

Figure 4:
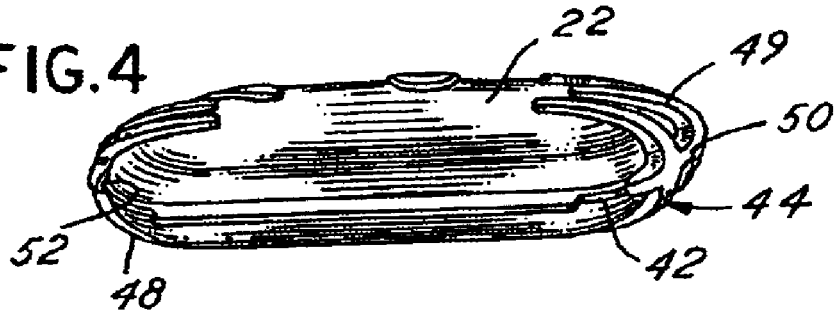
FIG. 4 is an isometric view of an alternative bladder and protective cage of FIG. 2.
Figure 9:
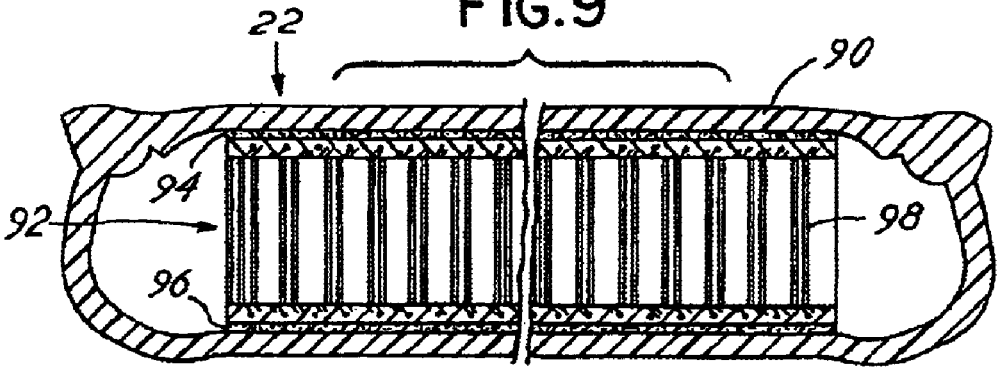
FIG. 9 is a cross section view of an exemplary bladder used with the present invention.

The bladder used with the present invention may be any type of known bladder, which may be formed by any known manufacturing technique. The design, style, and type of bladder is not significant as the present invention may be designed, configured, formed, or adapted to accommodate any type of bladder. As shown in the figures, exemplary bladders are depicted which may be used with the present invention. Referring to FIGS. 3, 4, and 9, there is illustrated a known bladder 22 described in U.S. Pat. No. 6,119,371 to Goodwin and owned by NIKE, Inc., the details of which are incorporated by reference. Briefly, the bladder 22 is formed of an outer enclosing member 90 and an inner member 92. The outer enclosing member is formed of a TPU film having two layers of material. The TPU film forms the shell shape of the bladder and defines a sealed chamber. The inner member 92, which is located within the sealed chamber, is formed of spaced apart fabric layers 94, 96 connected together by a plurality of connecting yarns or drop threads 98. The sealed chamber formed by the outer enclosing member contains a pressurized fluid to place the plurality of connecting yarns under tension. For a more detailed discussion of bladder 22, reference should be made to U.S. Pat. No. 6,119,371.

Figure 5:
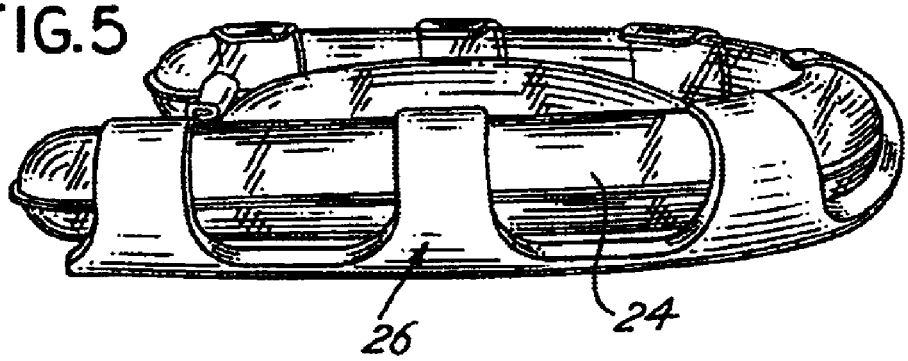
FIG. 5 is an isometric view of an alternative bladder and protective cage of FIG. 2.

Other types of known bladders are disclosed in U.S. Pat. Nos. 5,713,141 and 5,952,065 to Mitchell et al., and U.S. Pat. No. 5,353,459 to Potter et al., all owned by NIKE, Inc.; and U.S. Pat. Nos. 4,506,460 and 4,219,945 to Rudy, the disclosures of which are incorporated by reference. As depicted in FIG. 5, bladder 24 is similar to these known bladders, which are known generally as permanently filled bladders. The permanently filled bladders are formed by various techniques. For instance, the bladders may be formed by sheets of elastomeric film, which may be welded together along their periphery to define an enclosed chamber. The enclosed chamber is pressurized with a gas or liquid and sealed to create an inflated resilient bladder. Alternatively, the bladders may be formed by a blow molding technique to create the desired bladder configuration. With this technique, a liquefied elastomeric material is placed in a mold having the desired overall shape and configuration of the bladder. The mold has an opening at one location through which presurized air forces the liquefied elastomeric material against the inner surfaces of the mold and causes the material to harden in the mold to form the bladder. Again, for a more detailed discussion of these known bladders, reference should be made to aforementioned patents.

In use, the known bladders, typically made from an elastomeric material, undergo continual and sometimes extreme loading caused by the wearer of the footwear. This continual, repetitive loading on the bladder reduces the integrity of the bladder. Specifically, the film walls of the bladder undergo constant flexing and stretching, which eventually leads to fatigue failure in the film walls and eventual bladder failure. To prevent such bladder failure, tests have shown that control of the bladder film wall flexing will control bladder fatigue and will increase the longevity and durability of the bladder. The present invention is directed to providing such control.

As illustrated in the figures, the invention is directed to a bladder or cushioning device support system that improves bladder durability by preventing the bladder from experiencing over flexing of the bladder film, which, as stated above, leads to material breakdown and eventual bladder failure. Referring to FIG. 2, in an exemplary embodiment, the bladder support system of the present invention includes the use of a protective cage 26, which encases the bladder and provides structural support to the bladder, in particular, the side walls of the bladder where stresses on the bladder film are the greatest. The support provided by this protective cage has been shown to significantly reduce, if not eliminate, bladder failure due to film flex fatigue, and protect the bladder from abrasions, which also leads to bladder film breakdown. For instance, tests conducted of running shoes, with and without the present invention and with an average distance run of approximately 350 miles, have yielded results demonstrating bladder failure in approximately 20% of the shoes not using the protective cage, while similar testing of running shoes incorporating the protective cage have resulted in no bladder failures.

In accordance with the invention, the protective cage 26 may be any resilient, durable structure that contains the bladder and provides structural support to the bladder to reduce the likelihood of bladder failure. As a result, the, cage may take on many shapes and configurations and may be made of numerous materials depending on the application. With respect to the preferred material properties, general criteria include mechanical strength, fatigue resistance, stiffness, abrasion and wear. Suitable materials include, but are not limited to, engineering or performance polymers, such as Hytrel® 5526, which is a thermoplastic polyester elastomer manufactured by DuPont, and Pebax® 5533, which is a thermoplastic polyester elastomer manufactured by Elf Atochem. With respect to these materials, Hytrel® 5526 exhibits a tensile strength of approximately 5800 psi, an elastic modulus of approximately 18000 psi, a flex modulus of approximately 30023 psi, and a tabar abrasion of approximately 70 mg/1000 rev. Similarly, Pebax® 5533 exhibits a tensile strength of approximately 6382 psi, an elastic modulus of approximately 21031 psi, a flex modulus of approximately 23206 psi, and a tabar abrasion of approximately 65 mg/1000 rev. One of skill in the art will recognize that, in addition to the above materials, other materials exhibiting similar properties may be used to manufacture the cage of the present invention.

In one aspect of the invention, the cage defines a cage base 28 and a plurality of fins or bladder support members 30 extending outwardly from the cage base at the periphery of the base. Also located at the periphery of the cage base is a reinforcing rim 32, which provides structural support for the base and the fins. While the depicted reinforcing rim 32 extends around the entire perimeter of the base, the rim may also be localized below the fins.

In use, the fins are located adjacent to and extend along the side walls of the bladder to work intimately with the bladder during cushioning. The fins act as structural elements to attenuate film stress in the bladder by limiting localized deflection along the side walls of the bladder. The fins also serve to protect the sidewall and flange of the bladder from excessive abrasive wear. In a preferred embodiment, the fins are not secured to the side walls of the bladder. Bonding of the fins to the side walls will have the undesirable effect of increasing the stresses on the film surface in the bonded region during loading. Instead, the fins are secured to the bladder top or bottom surface walls, as described below.

Figure 7:
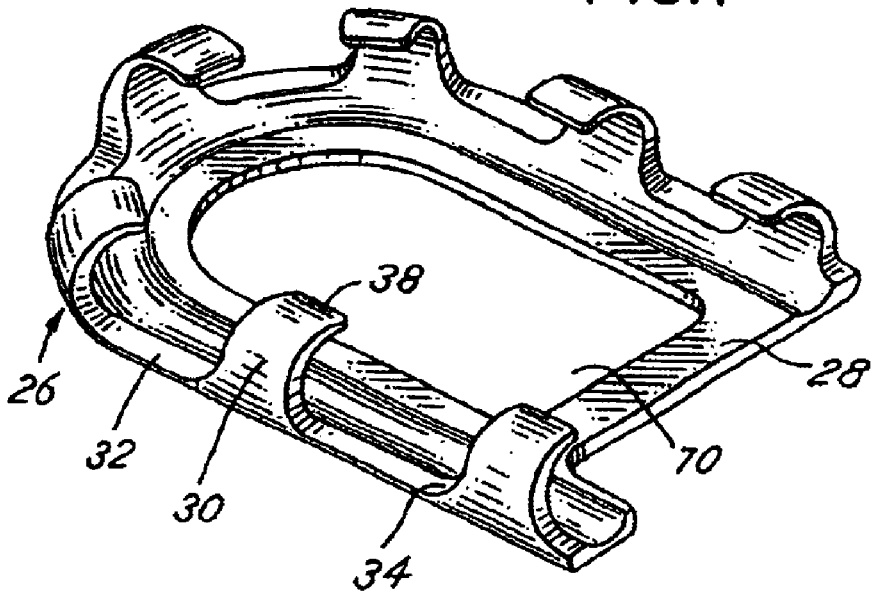
FIG. 7 is an isometric view of an alternative embodiment of the protective cage of FIG. 2.

The cage base 28 may be any fin-support member that joins or ties together all the fins. The cage base is sometimes referred to as a moderator surface. The cage base may include, but is not limited to, a solid plate on which is bonded the bladder. Alternatively, the base may include a plate, which has one or more apertures or openings, as shown in FIG. 7, to provide weight reduction and greater flexibility for the footwear. The base may also include a plurality of straps, as shown in FIG. 8, to again provide weight reduction and enhanced flexibility for the footwear. One of skill in the art will appreciate that the aforementioned base designs are illustrative of the many potential designs.

Referring back to FIG. 2, the fins 30 of the present invention further include structural gussets 34, living hinges 36, and bonding tabs 38. The gussets 34 are located at the base of each fin between the bonding tab 38 and the support rim 32 and provide structural support and strength for the fins. The living hinges 36 are located at the juncture between the gussets 34 and tabs 38 and provide a pivot point for the bonding tab. The living hinges 36 also receive the bladder to align the bladder within the cage. Specifically, the living hinge forms a groove 40 that receives the flange 42 of the bladder, thereby seating or positioning the bladder within the cage. The bonding tab 38 is the portion of the fin that folds over the bladder top or bottom surface and attaches to the surface of the bladder to prevent movement of the bladder. The attachment of the tab 38 to the bladder may be accomplished through the use of an adhesive or any other suitable method of attaching the tabs to the bladder.

As depicted in FIG. 2, the fins are flexible and resilient and define a thickness 54 that gradually decreases from the gussets 34 toward the bonding tab 38. In other words, the base of the fin is thicker and less flexible than the tip of the fin. The change in thickness affects the degree of bending experienced by the fin when the lateral component of a vertical load imparts bending force on the fin. That is, when a load is placed on the bladder causing the fins to begin flexing, each fin will resist a portion of the load and will bend around an axis across the fin's width. As the load increases, the location of the bending in the fin changes position toward the thicker base of the fin, which will provide a greater resistance to bending from the greater cross-section moment of inertia. As a result, because the thickness of the fin increases toward the base, the flex or stretch of the bladder side walls will be controlled regardless of the loading placement on the bladder.

It will be understood by those skilled in the art that design variables exist with respect to the cage 26 depending on the desired control, support and overall protection provided by the cage. For example, the number, width, thickness, profile, material modulus, and location of the fins may be varied. More fins may be located on one side of the footwear to provide additional bladder support for people who either pronate or suppinate. Moreover, the location and placement of fins may be varied depending on the sport and the demands placed on the footwear. For instance, running shoes are sometimes classified as fore and aft loading situations, while court sports, such as basketball, tennis, and cross training produce not only fore and aft loading but also lateral loading situations from cutting motions. As a result, the desired number and positioning of the fins will be different for specific athletes, sports, and shoes.

It should be understood by those skilled in the art that the cage of the present invention and accompanying bladder may be located in any portion of the sole of the footwear, including the midsole and outsole, and at numerous locations along the footwear, including, by way of example, the forefoot, midfoot and rearfoot regions of the footwear. It should be further understood that the cage and bladder may be positioned in the sole such that the cage and bladder are visible to the outside. Alternatively, the cage and bladder may be positioned in the sole such that the cage and bladder are fully encapsulated within the foam material that forms the midsole of the footwear.

Figure 11:
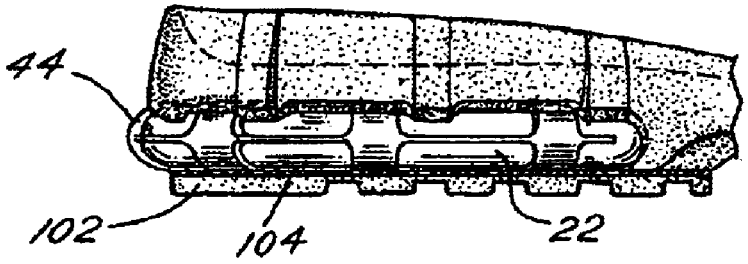
FIG. 11 is a partial side view of an article of footwear incorporating the protective cage of the present invention.

It should also be understood that other variables include the location of the cage base relative to the bladder. That is, the base plate can be positioned on either side of the bladder. Referring to FIG. 11, if the base plate of the cage 44 is positioned on the bottom surface of the bladder 22 between the bladder and the outsole 102, it may be desirable to incorporate a relatively thin piece of foam 104, or other cushioning material, to create a flexible middle zone. The flexible middle zone creates more flexibility between the cage base plate and the outsole, which may serve to improve the friction wear rate of the outsole. In an alternative embodiment, a base plate may be located on both sides of the bladder. If two base plates are used, the fins can either attach to both surfaces of the bladder or to only one surface with the remaining unattached fins floating over the other surface of the bladder under loaded conditions.

It should be noted that while it is preferred that the fins are not attached to the bladder side walls, it is within the scope of the invention to attach the fins to the side walls. Similarly, it is within the scope of the invention to mold the fins into the side walls of the bladder through known molding techniques. Using this approach, the base becomes optional as the fins are molded in position around the periphery of the bladder to serve as structural support to the bladder side walls.

Figure 8:
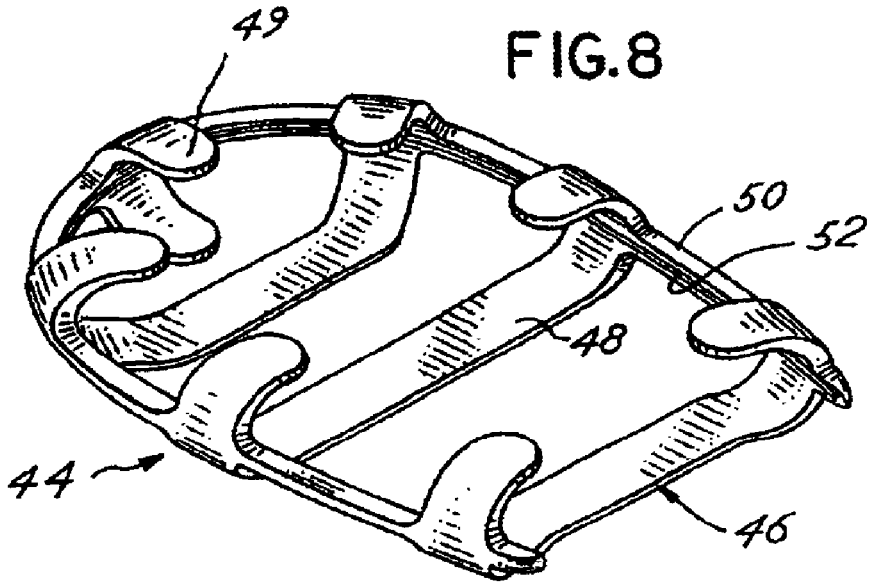
FIG. 8 is an isometric view of another alternative embodiment of the protective cage of FIG. 2.
Figure 10:
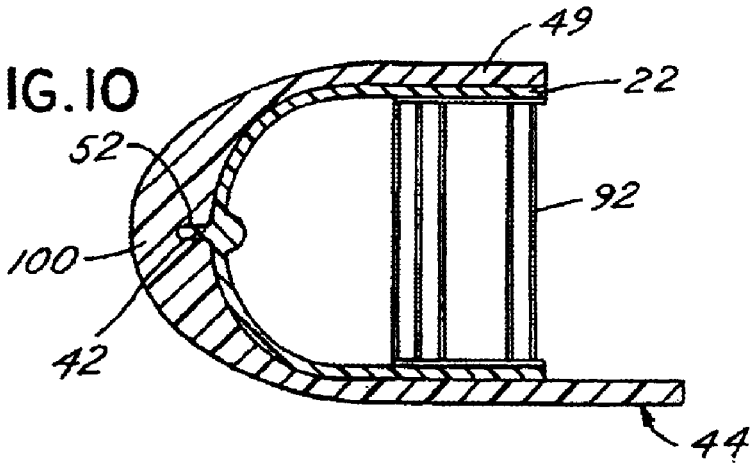
FIG. 10 is a partial cross section view of the bladder and protective cage of FIG. 4.

Referring to FIGS. 4, and 8 there is shown an alternative embodiment of the cage of the present invention. In this embodiment, the cage 44 includes a cage base 46 that defines a plurality of straps 48 that form fins 49. The fins 49 define a curvature and are joined by a horizontal rib 50 that extends along the periphery of the cage. The rib 50 includes a channel 52 that receives the bladder flange 42 and aligns and holds the bladder in position. Referring to FIG. 10, the fins 49 not only define a curvature but also increase in thickness at a center region 100. The curved shape and thicker center-region configuration of the fins 49 permit each fin to serve as a load-bearing beam to resist vertical loads exerted on the fins by the bladder and prevent deflection of the bladder side walls. That is, when a load is placed on bladder causing the fins to begin flexing, each fin will resist a portion of the load and will bend around an axis across the fin's width. As the load increases, the location of the bending in the fin changes position toward the thicker center region, which will provide a greater resistance to bending from the greater cross-section moment of inertia. As a result, because the thickness of the fin increases toward the center, the flex or stretch of the bladder side walls will be controlled regardless of the loading placed on the bladder. The concept of load-bearing beams to control vertical loads is well known and can be further understood by reference to *Fundamentals of Machine Component Design*, Second Edition, Robert C. Juvinall and Kurt M. Marshek, pp. 454–55 (1991). Again, as above, design variables exist with respect to the cage 44 depending on the desired control, support and overall protection provided by the cage. That is, and as stated above, the number, width, thickness, profile, material modulus, and location of the fins may be varied. In addition, more fins may be located on one side of the bladder to provide targeted bladder support.

Referring to FIGS. 5 and 7, another alternative embodiment of the cage of the present invention is depicted. The cage 26 includes a cage base 28 which has an opening or aperture 70 through the base. As with the other embodiments, the fins 30 extend outwardly from the cage base 28 at the periphery of the base to surround or encase bladder 24, which is a blow molded bladder of the type described above. Also located at the periphery of the cage base is a reinforcing rim 32, which provides structural support for the base and the fins. As above, while the depicted reinforcing rim 32 extends around the entire perimeter of the base, the rim may also be localized below some or all of the fins. The fins 30 further include the aforementioned structural gussets 34 and bonding tabs 38, which bond to the bladder in the manner described above.

It will be recognized that the illustrated embodiments can be modified in arrangement and detail without departing from the scope of the present invention. Therefore, to particularly point out and distinctly claim the subject matter regarded as the invention, the following claims conclude the specification.

What is claimed is:

1. An article of footwear comprising:

an outsole, a midsole attached to the outsole, an upper attached to the midsole, a cushioning device located between the outsole and the upper, the cushioning device having a first surface, a second surface, and a side wall joining the first and second surfaces, and a cage defining a base, a plurality of spaced apart ribs, and a reinforcing rim, the reinforcing rim extending from the base along the side wall of the cushioning device, the plurality of ribs extending outwardly from the base and along the side wall of the cushioning device from the first surface to the second surface of the cushioning device, the plurality of spaced apart ribs joined together by the reinforcing rim, whereby the plurality of ribs provide support to the side wall of the cushioning device.

2. The article of footwear of claim 1 wherein each of the plurality of ribs defines a gusset connected to the base.

3. The article of footwear of claim 2 wherein the base extends across either of the first or second surface of the cushioning device.

4. The article of footwear of claim 3 wherein the cushioning device is located in the midsole.

5. The article of footwear of claim 1 wherein at least one of the spaced apart ribs defines a first end and a second end, the first end attached to the base, and wherein the first end and second end define a thickness, the thickness of the first end being greater than the thickness of the second end.

6. The article of footwear of claim 1 wherein at least one of the spaced apart ribs defines a first end, a second end, and a middle portion between the first and second ends, and wherein the first end, second end and middle portion define a thickness, the thickness of the middle portion being greater than the thickness of the first or second ends.

7. The article of footwear of claim 1 wherein the base is a solid plate.

8. The article of footwear of claim 1 wherein the base is a solid plate having at least one opening extending through the solid plate.

9. The article of footwear of claim 1 wherein the base, the reinforcing rim, and the plurality of ribs define a plurality of openings, the cushioning device being visible through the plurality of openings.

10. The article of footwear of claim 1 wherein the cushioning device defines a periphery, the plurality of ribs positioned and spaced apart around the periphery of the cushioning device.

11. The article of footwear of claim 10 wherein the plurality of ribs are flexible and resilient.

12. An article of footwear comprising:

an outsole, an upper positioned above the outsole, a cushioning device located between the outsole and the upper, the cushioning device having a first surface, a second surface, and a side wall joining the first and second surfaces, and a cage defining a base, a plurality of spaced apart ribs, and a reinforcing rim, the reinforcing rim extending from the base along the side wall of the cushioning device, the plurality of ribs extending outwardly from the base and along the side wall of the cushioning device from the first surface to the second surface of the cushioning device, the cushioning device being visible through the spaced apart ribs, the plurality of spaced apart ribs joined together by the reinforcing rim, whereby the plurality of ribs provide support to the side wall of the cushioning device.

13. The article of footwear of claim 12 wherein each of the plurality of ribs defines a gusset connected to the base.

14. The article of footwear of claim 13 wherein the base extends across either of the first or second surface of the cushioning device.

15. The article of footwear of claim 14 wherein the cage is positioned between the upper and the outsole.

16. The article of footwear of claim 12 wherein at least one of the spaced apart ribs defines a first end and a second end, the first end attached to the base, and wherein the first end and second end define a thickness, the thickness of the first end being greater than the thickness of the second end.

17. The article of footwear of claim 12 wherein at least one of the spaced apart ribs defines a first end, a second end, and a middle portion between the first and second ends, and wherein the first end, second end and middle portion define a thickness, the thickness of the middle portion being greater than the thickness of the first or second ends.

18. The article of footwear of claim 12 wherein the base is a solid plate.

19. The article of footwear of claim 12 wherein the base is a solid plate having at least one opening extending through the solid plate.

20. The article of footwear of claim 12 wherein the base, the reinforcing rim, and the plurality of ribs define a plurality of openings, the cushioning device being visible through the plurality of openings.

21. The article of footwear of claim 12 wherein the cushioning device defines a periphery, the plurality of ribs positioned and spaced apart around the periphery of the cushioning device.

22. The article of footwear of claim 21 wherein the plurality of ribs are flexible and resilient.

23. An article of footwear comprising:

an outsole, an upper positioned above the outsole, a bladder located between the outsole and the upper, the bladder having opposing surfaces and a side wall joining the opposing surfaces, the bladder defining a periphery, and a bladder support device defining a plurality of spaced apart support members and at least one reinforcing rib joining the plurality of space apart support members, the plurality of spaced apart support members extending outwardly from the reinforcing rib, along the side wall of the bladder, and around the periphery of the bladder, whereby the reinforcing rib and the plurality of support members define a plurality of openings, the bladder being visible through the plurality of openings.

24. The article of footwear of claim 23 wherein each of the plurality of support members defines a gusset connected to the reinforcing rib.

25. The article of footwear of claim 23 wherein the bladder support device further defines a base.

26. The article of footwear of claim 25 wherein at least one of the spaced apart support members defines a first end and a second end, the first end attached to the base, and wherein the first end and second end define a thickness, the thickness of the first end being greater than the thickness of the second end.

27. The article of footwear of claim 25 wherein at least one of the spaced apart support members defines a first end, a second end, and a middle portion between the first and second ends, and wherein the first end, second end and middle portion define a thickness, the thickness of the middle portion being greater than the thickness of the first or second ends.

28. The article of footwear of claim 25 wherein the base is a solid plate.

29. The article of footwear of claim 25 wherein the base, the reinforcing rib, and the plurality of support members define a plurality of openings, the bladder being visible through the plurality of openings.

30. The article of footwear of claim 23 wherein the bladder support device is positioned between the upper and the outsole.

31. The article of footwear of claim 23 wherein the plurality of support members are flexible and resilient.

* * * * *